United States Patent [19]

Clark et al.

[11] Patent Number: 4,684,190

[45] Date of Patent: Aug. 4, 1987

[54] SEALED ELECTRICAL CONNECTOR WITH SHROUD

[75] Inventors: Roger A. Clark, Warren; Paul D. Doherty, Cleveland Heights; Emil J. Tolnar, Jr., Cortland, all of Ohio

[73] Assignee: General Motors Corporation, Detroit, Mich.

[21] Appl. No.: 836,498

[22] Filed: Mar. 5, 1986

[51] Int. Cl.[4] ..... H01R 11/00

[52] U.S. Cl. ..... 439/587; 439/277; 439/364; 439/552

[58] Field of Search ..... 339/94, 125 R, 126 RS, 339/92, 217 R

[56] References Cited

U.S. PATENT DOCUMENTS 2,610,222 9/1952 Burtt et al. ..... 339/92 M
3,043,925 7/1962 Wilson ..... 339/92 M
3,159,444 12/1964 Stine ..... 339/92 M
4,193,655 3/1980 Herrmann, Jr. ..... 339/94 M

*Primary Examiner*—Gil Weidenfeld
*Assistant Examiner*—David Pirlot
*Attorney, Agent, or Firm*—Arthur N. Krein

[57] ABSTRACT

A flanged hollow shroud that is adapted to be sealingly secured to an aperture bulkhead as used, for example, in a vehicle to separate an engine compartment from a passenger compartment, is used to telescopically receive the mating end of a pair of male and female connectors having mating electrical terminals therein. At least one of the connectors, such as the male connector located on the engine compartment side of the bulkhead is sealingly fixed to the shroud and the electric terminals therein are also sealed adjacent to their outboard end within the respective cavities supporting these terminals.

2 Claims, 5 Drawing Figures

SEALED ELECTRICAL CONNECTOR WITH SHROUD

FIELD OF THE INVENTION

This invention relates generally to electrical connectors as used to carry and protect electrical wiring means extending, for example, from an engine compartment through an apertured bulkhead into the passenger compartment of a vehicle and, in particular to a sealed electrical connector with sliding shroud for such an application.

DESCRIPTION OF THE PRIOR ART

It is well known in the art to use various forms of grommets to permit for the passage of electrical conductors from a first compartment to a second compartment with these compartments being separate by an apertured bulkhead.

In recent years with the increased use of power assisted components and other electrical operated elements in motor vehicles, it has been found desirable to commercially use grouped terminals in matable plug and socket connectors and it has been conventional to provide at least one of the connectors with a flange and a gasket like seal arrangement together with some form of mechanical fastener whereby the connectors could be secured to the apertured bulkhead with the gasket seal sealingly sandwiched between the flange and the surface of the bulkhead surrounding the associate aperture therethrough.

In such prior art connector structures, no suitable provisions had been made to seal off the electrical terminals, as, for example, the terminals positioned in the male connector, which connector is normally located on the engine compartment side of the bulkhead.

SUMMARY OF THE INVENTION

The present invention relates to an electrical connector assembly having matable, male and female connectors each having plural longitudinal extending apertures therein with each such aperture having an associate electrical terminal with an electrical cable sealingly engaged in the aperture of the male connector and extending outboard therefrom, the male and female connectors also having plural transverse apertures so as to receive lock combs to effect axial retention of the electrical terminals, the mating ends of the male and female connectors with the lock combs installed being slidably received in a shroud of an internal hollow configuration conforming substantially to the exterior of the mating ends of male and female connectors, the shroud being provided with an external annular flange whereby the shroud can be sealingly engaged to an apertured bulkhead. A fastener means is associated with the male and female connectors to securely mate these elements together and to trap the shroud therebetween with this fastener means providing the force to seal the shroud to the male connector by means of an O-ring compression seal that is trapped between an end of the shroud and the base of an annular grooved flange provided for this purpose on the outboard end of the male connector.

It is therefore a primary object of this invention to provide an improved matable electrical engine harness and instrument panel harness connector through an apertured bulkhead, wherein the mating male and female connectors for these harnesses are slidably and sealingly received within a one-piece, plastic tubular shroud with these connectors being secured to the shroud by a suitable threaded fastener means.

Another object of this invention is to provide an improved matable electrical connector assembly with an enclosing sliding shroud wherein lock ramps are provided on the shroud to facilitate snapping of the male connector to it for shipment of this electrical connector subassembly to a vehicle assembly plant.

For a better understanding of the invention as well as other objects and further features thereof, reference is had to the following detailed description of the invention to be read in connection with the accompanying drawings.

Figure 1:
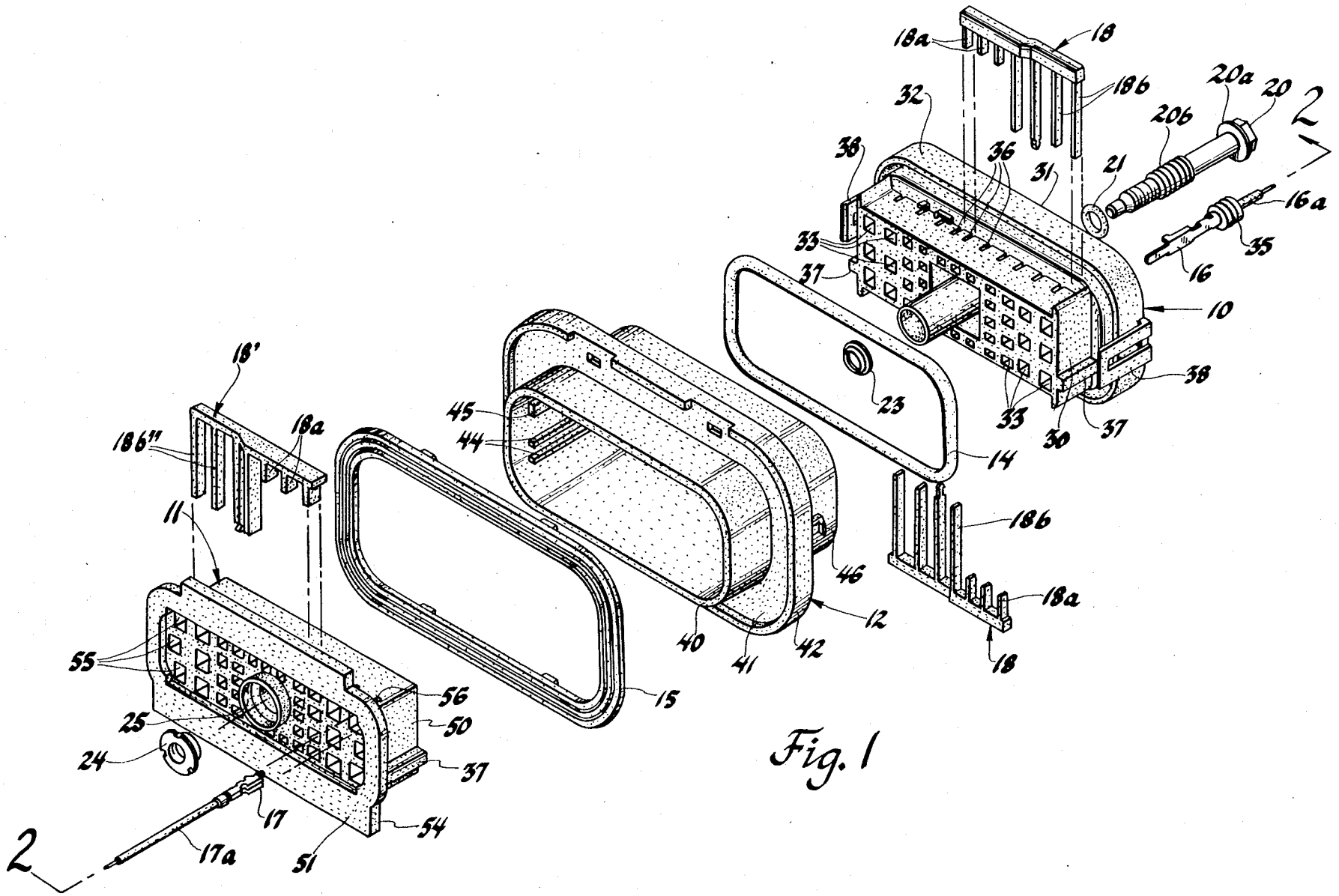
FIG. 1 is an exploded perspective view of the sealed, mating electrical connectors with sliding shroud, per se, in accordance with the invention.
Figure 2:
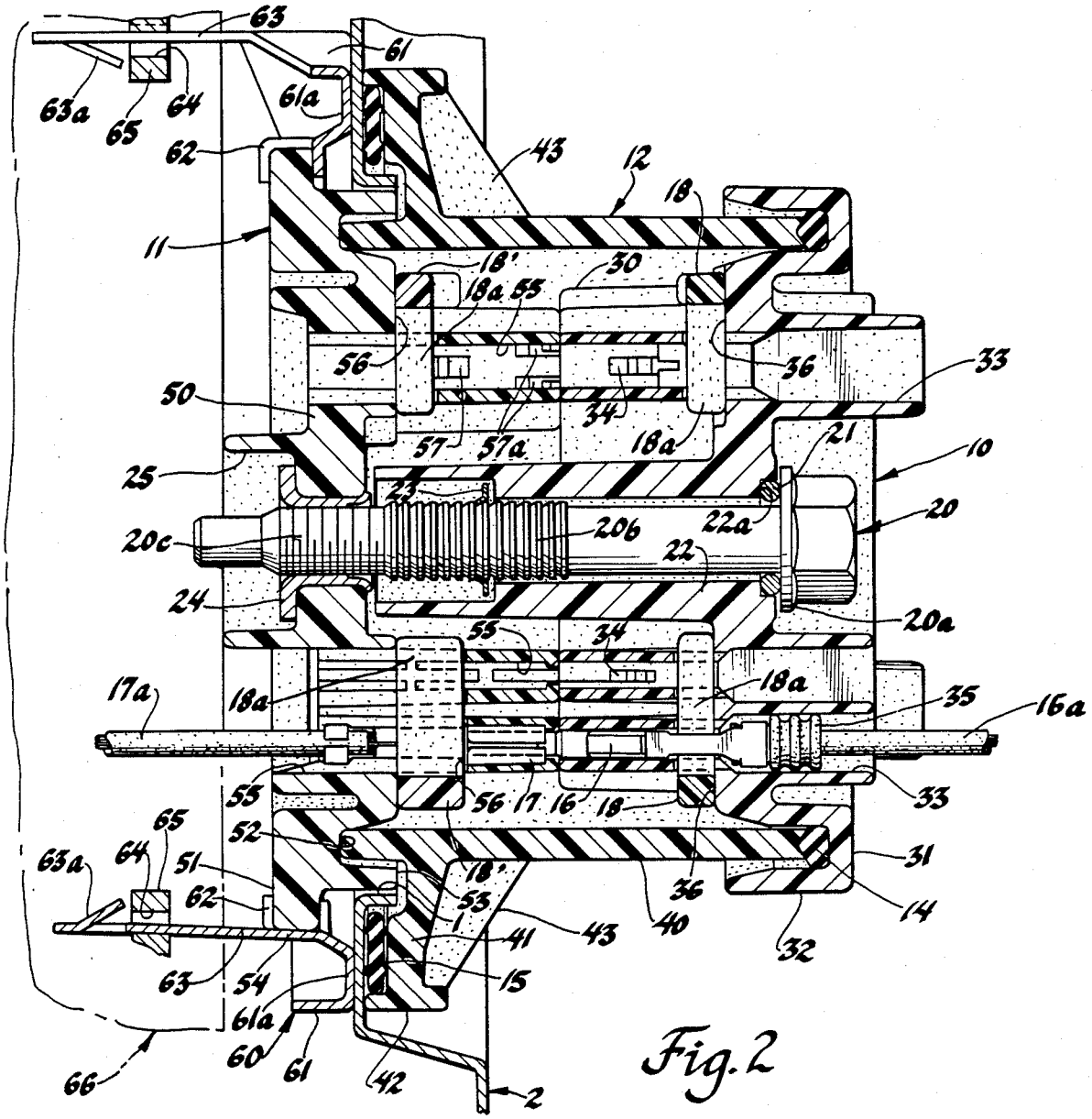
FIG. 2 is an off-set cross-sectional view taken along substantially line 2—2 of FIG. 1 of the elements illustrated in FIG. 1 assembled together and secured to an apertured bulkhead, with a preferred embodiment of the female connector being shown whereby the female connector is mounted on a bulkhead bracket adapted to engage one side of the apertured bulkhead and which bulkhead bracket, in turn, is slidably supported on an element, such as a heater core of the heating ventilation and air conditioning system, (HVAC) of a vehicle.
Figure 3:
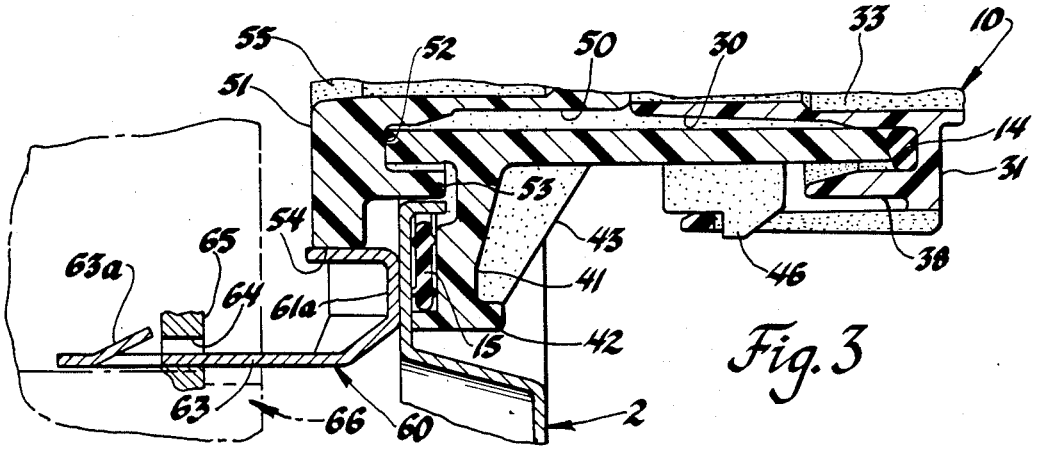
FIG. 3 is a sectional view of a portion of the assembly of FIG. 2 to show a shipping lock assembly between the male connector and shroud of the electrical connector assembly.

Referring now in particular to FIGS. 1, 2 and 3 there is shown a sealed electrical connector with sliding shroud, in accordance with the invention for use in, for example, a vehicle to connect an electrical engine harness with an electrical instrument harness through an aperture 1 in a bulkhead 2, with reference to FIGS. 2 and 3. The bulkhead 2, as conventional in a vehicle, is used to separate the engine compartment, on the right hand side of the bulkhead, from the passenger compartment on the left hand side of the bulkhead with reference to these Figures.

The electrical connector with sliding shroud assembly includes a male connector 10 and mating female connector 11, each of which has an inboard end thereof slidably received in a shroud 12. In the construction shown, a rectangular seal ring 14 is used to effect a seal between the male connector 10 and an associate end of the shroud 12 and a bulkhead gasket seal 15 is associated with the opposite end of the shroud 12 for sealing engagement with the bulkhead 2, all in a manner to be described.

As is conventional, both of the male and female connectors 10 and 11, respectively, are provided with suitable longitudinal extending apertures to receive a set of mating terminals 16 and 17, each of which is fixed to an electrical cable 16*a* and 17*a*, respectively, extending outward from the respective connectors, only one set of such terminals and cables being shown. As conventional, suitable lock combs 18 and 18' are used to axially retain the terminals in their respective connectors.

In addition, a bolt 20, with an O-ring seal 21, extends through a bolt aperture 22 in the male connector 10 and is held captive therein by a bolt retainer 23, the threaded end of the bolt being adapted to be threaded into a T-nut 24 mounted in a nut receiving stepped aperture 25 provided for this purpose in the female connector 11.

Referring now to the male connector 10, it is a one-piece molding of dielectric material and includes a main body portion 30, of substantially rectangular configuration in the construction illustrated, which is encircled adjacent to its outboard end, the right hand end with reference to FIGS. 1, 2 and 3, by a radial outward extending flange 31 connected to an annular flange 32 that is located so as to extend toward the inboard end of the main body portion 30 a predetermined extent whereby to define a channel of a suitable size to receive the seal ring 14.

As best seen in FIGS. 1 and 2, the bolt receiving bore 22, of stepped internal configuration, is centrally located in the main body portion 30 of the male connector 10. As best seen in FIG. 2, the shank of the bolt 20 is inserted into bore 22 from the outboard end of the male connector, with this bolt 20 having a flanged head **20*a* whereby it is adapted to sealingly engage the O-ring seal 21 and, in the construction shown, the intermediate shank portion of the bolt is provided with knurled annular grooves 20*b* so as to receive the inclined inner locking edge of a conventional retainer 23 whereby the bolt 20 is held captive within the male connector 10**.

In addition, the main body portion 30 of the male connector 10 is provided with substantially vertical and horizontal aligned rows of cavities 33 extending longitudinally therethrough substantially parallel to the axis of the bore 22. In the construction shown, 36 such cavities 33 are provided in the main body portion. It will be realized, however, that any number of such cavities can be used, as desired, for a particular vehicle application. It should also be appreciated by those skilled in the art that these cavities 33 will be of different sizes depending on the size of the terminal 16 to be accommodated therein, since different electrical loads require different size terminals, as is well known in the art.

As best seen in FIG. 2, each cavity 33, at its left or inboard end is of either substantially square or rectangular configuration depending on the size and shape of the terminal 16 to be mounted therein with each such portion having a conventional lock shoulder means 34, as seen in FIG. 2, provided therein to effect primary axial retention of an associate terminal 16 positioned therein. Each of these cavities 33, at its opposite or outboard end, is of circular cross-sectional configuration and of a suitable predetermined internal diameter so as to receive an annular cable seal ring 35 of suitable size whereby this cable seal ring sealingly encircles an associate cable **16*a* next adjacent to the associate terminal 16 and also sealingly engages the interior circular interior wall of this round portion of the cavity 33 into which it is inserted. As should now be apparent, the circular cross-section of a respective cavity and the cable seal ring 35 will be appropriately sized so as to accommodate the size of the connector 16 and cable 16*a* with which it is to be used. Thus, with this arrangement, each connector 16 in its associate cavity 33 in the male connector 10** will be sealed relative to environment in the engine compartment side of the assembled connector and shroud assembly, in the construction illustrated.

In addition, the main body portion 30, inboard of flanges 31, 32, is provided with transverse openings 36, extending vertically with respect to FIGS. 1 and 2, so as to intersect at least a portion the vertical aligned rows of cavities 33 and to also intersect the individual cavities 33 above and below the bolt receiving bore 22 in a well known manner, so as to receive the teeth **18*a* of conventional type secondary lock combs 18 to further assist in axial retention of the connectors 16 in a suitable manner known in the art. As best seen in FIG. 1, two such secondary lock combs 18 are used with the male connector 10 in the construction illustrated, one of the combs 18 being inserted through the openings 36 from the upper right hand side of the connector body portion 30, with reference to FIG. 1, while the other comb 18 is inserted through the openings 36 from the lower left hand end, and, as will be apparent, the small teeth 18*a* of these combs 18 enter the horizontal row of cavities 33 directly above and below the central bolt receiving bore 22, while the large teeth 18*b* extend through the vertical rows of cavities 33**.

The male connector 10 is also provided on opposite sides of the main body portion 30 thereof with longitudinal extending orientation ribs 37 (seen in FIG. 1) and with a set of side flexible lock fingers 38 which extend from the flange 32 toward the inboard end of the male connector 10, as seen in FIGS. 1 and 3, for a purpose to be described.

Referring now to a feature of the invention, the mating male and female connectors 10 and 11, respectively, are adapted to be slidably received in the shroud 12 which is a solid, one-piece, plastic, hollow cylinder of substantially rectangular configuration, in the construction shown, so as to be of complementary similar internal configuration to that of the exterior of inboard end of the described male connector 10 and the to be described female connector 11, both with the associated secondary lock combs 18 and 18', respectively, secured to these last mentioned connector elements.

Thus as shown, the shroud 12 includes a tubular shell 40 with an encircling stepped radial flange 41 extending outward therefrom closely adjacent to one end, the left hand, with reference to FIGS. 1, 2 and 3, which may be referred to as the bulkhead end of the shroud. In addition, as shown in these Figures and in the alternate embodiment shown in FIG. 4, this flange 41 is connected to an annular retaining flange 42 that extends a predetermined extent toward this one end or bulkhead end of the shroud, whereby this retaining flange 42 and the adjacent radial inboard surface of the flange 41 serve as a retainer and abutment surface, respectively, for the gasket seal 15.

As best seen in FIGS. 2 and 3, circumferentially spaced apart reinforcing ribs 43 are preferably provided so as to interconnect the shell 40 and at least one side of the flange 41 together whereby to prevent flexing of the flange 41 so that positive sealing of the gasket seal 15 against the engine compartment side of the bulkhead 2 will be obtained.

Also, as best seen in FIGS. 2 and 3, the wall thickness of the shell 40 is preselected whereby the end of this shell 40 encircling the body portion 30 of male connector 10 will be slidably received in the annular groove defined by the body portion 30 and flanges 31, 32 so that its free end can sealingly engage the seal 14.

As best seen in FIG. 1, the interior wall of the shell 40 is provided on opposite sides thereof with raised spaced apart orientation guide rails 44, each such set of orientation guide rails 44 defining therebetween a groove of a size to slidably receive an associate orientation rib 37 on the male connector 10 and, to also receive a similar pair of orientation ribs 37 that are provided for this purpose on the female connector 11, to be described. Above the orientation guide rails 44 there is provided a stop bar 45, only one set of these elements being seen in FIG. 1. The stop bar 45 is located such that if either the male or female connector 10 and 11, respectively, is inverted from their respective positions shown in FIG. 1, the orientation ribs 37 on either of these connectors would abut against the stop bar 45 so as to indicate to an assembler that such male or female connector was not properly orientated for correct mating with each other, whereas, if orientated as shown, the ribs 37 will be received between the orientation guide rails 44, whereby the male and female connectors 10 and 11, respectively, will be properly guided for mating connection of the associate terminals 16 and 17, respectively, of these connectors.

As best seen in FIGS. 1 and 3, the shell 40 of the shroud 12 is also provided on opposite sides thereof with an outward extending detent tab lock 46 for locking engagement with an associate flexible lock finger 38 on the male connector 10 whereby to permit for the unit assembly of these elements during shipment of these elements to a vehicle assembly plant.

Referring now to the female connector 11, also made of a dielectric material, it includes a main body portion 50, of a configuration comparable to the main body portion 30 of the male connector 10, which is encircled adjacent to its outboard end, the left hand end with reference to FIGS. 1, 2 and 3, by a radial outward extending flange 51. In the embodiment shown in these FIGS. 1, 2 and 3, this flange 51 is of stepped configuration both in regard to its external configuration and on its inboard or left hand side configuration, with reference to these Figures. Thus as best seen in FIGS. 2 and 3, the inboard side of the flange 51 is provided with a groove recess 52 of a suitable width and depth to receive the bulkhead or left hand end of the shell 40 of shroud 12, this groove recess 52 being defined in part by an outer longitudinal extending flange portion 53, the upper or outer peripheral surface of which is sized so as to loosely extend through the aperture 1 in the bulkhead 2 and by an outer rim 54 of predetermined width. As shown, this rim 54 is sized so as to encircle the aperture 1 in the bulkhead 2 outboard of this aperture 1 and of a size whereby it can be supported in a bulkhead bracket 60, to be described in detail hereinafter, in accordance with a preferred embodiment for a particular vehicle application.

As seen in FIGS. 1 and 2, the stepped aperture 25 in the body portion 50 of the female connector 11 is adapted to receive the T-nut 24, which nut preferably has its free shank end rolled outward to effect captive retention of the T-nut 24 in the female connector 11 and as illustrated this aperture 25 is also centrally located in the main body portion 50 of the female connector. Like the main body portion 30 of the male connector, the main body portion 50 of the female connector 11 is provided with substantially vertical and horizontal aligned rows of cavities 55 extending longitudinally therethrough in substantially parallel relationship to the axis of the stepped aperture 25. The number of rows and the number of such cavities corresponding to the cavities 33 in the associate male connector, with each such cavity containing a terminal 17 and cable 17*a* for mating engagement with a respective associate one of the terminals 16. In the construction shown, each such cavity 55 is of T-shaped configuration, as necessary, to receive the box-like inboard end of a particular terminal 17 and to provide a slot for entry of the inboard mating end of an associate terminal 16 in the male connector 10 therein during mating of these elements in a manner well known in the art. In addition each such cavity 55 is provided with suitable conventional type lock shoulder means 57, 57*a*, as shown in FIG. 2, to effect axial retention of an associate terminal 17 in a manner well known in the art.

The main body portion 50 of the female connector 11, inboard of the flange 51, is provided with transverse openings 56, similar to the openings 36 in the male connector to receive a pair of combs 18' in a manner and for the same purpose as the combs 18 used in the male connector 10, it being noted that only the upper comb 18' for the female connector 11 is shown in FIG. 1.

The female connector 11 is also provided on the sides of the main body portion thereof with longitudinal extending orientation ribs 37, the purpose of these ribs having previously been described.

The bulkhead bracket 60, made, for example, of sheet metal is, in effect, an open box-like frame of substantially rectangular configuration and of a size so as to define an open annular return bent flange 61 having the interior dimensions of its upright leg 61*a* corresponding to the shape of the aperture 1 in the bulkhead 2, with the length of this leg 61*a* being such so as to present an adequate abutment surface so that the material of the bulkhead 2 surrounding the aperture 1 and the gasket seal 15 an be tightly sandwiched between this leg 61*a* and the opposed gasket seal 15 side of the flange 41 of the shroud 12 in a manner to be described.

Extending outward from the back side, left side with reference to FIGS. 2 and 3, of the flange 61 are a plurality of spaced apart L-shaped support flanges 62 which cooperate with portions of the flange 61 so as to define a channel that is adapted to receive portions the outer peripheral flange portions of the annular rim 54 of the female connector 11.

In the construction illustrated the bulkhead bracket 60 is also provided with a plurality of spaced apart longitudinally outward extending, flexible lock fingers 63 having upstanding lock tabs 63*a* thereon whereby this bulkhead bracket 60 can be loosely supported by insertion of these lock fingers 63 through the apertures 64 in associate upstanding lock bars 65 that are provided in spaced apart relationship to each other on an element of the heating ventilation and air conditioning system (HVAC) of a vehicle, which element can be, for example, a heater core 66 that is located in the passenger compartment and which would be fixed in a conventional manner, not shown, to the passenger compartment side of the bulkhead 2.

With the arrangement shown, it will be apparent that with the bulkhead bracket 60 slidably fixed to the heater core 66 in the manner shown, an assembler need merely snap the rim 54 of the female connector 11 into the channel defined by the flanges 62 and associate portion of the flange 61 to effect positioning of the female connector 11 in substantial alignment within the aperture 1 in the bulkhead 2, a position which then permits its assembly into the shroud 12 and into mating assembly with the male connector 10, this latter part of the assembly being of course installed from the engine compartment side of the bulkhead 2.

As the female connector 11 and the shroud 12 with the male connector 10 partly fixed therein are axially pushed together, the free end of bolt 20 will be moved axially so as to extend through the T-nut 24 whereby the external threaded end 20*c* of the bolt 20 can become engaged with the internal threads of the T-nut. The assembler can then torque down the bolt 20 and as this occurs, the seal ring 21 will become sealingly compressed between the flanged head 20*a* of the bolt 20 and the shoulder 22*a* defined by the bolt aperture 22; the outboard end edge of the shroud 12 and male connector 10 will move axially relative to each other to sealingly compress the seal ring 14; and, the shroud 12 and the rim 54 of the female connector, as carried by the bulkhead bracket 60, will move axially relative to each other so that the gasket seal 15 becomes sealingly sandwiched between the engine compartment side surface of the bulkhead 2 and the opposed surface of the radial flange 41 of the shroud 12, the assembled position of these elements shown in FIGS. 2 and 3. Of course, as the above occurs, the male and female connectors 10 and 11, respectively, with the respective terminals 16 and 17 therein are brought into full mating engagement with each other.

As will become apparent from the alternate embodiments shown in FIGS. 4 and 5 and the description thereof hereinafter, the bulkhead bracket 60, although not forming a part of the subject sealed electrical connector with sliding shroud, per se, is used in the preferred embodiment illustrated in FIGS. 2 and 3 for the following reasons:

The bulkhead bracket 60 allows for easy serviceability of the subject sealed electrical connector, in that, if service is required, for example, of the female connector 11, a service person need first uncouple the bolt 20, and thereafter, from the passenger compartment side, pull the female connector 11 in an axial direction so as to pull it out from the shroud 12 and the bulkhead bracket 60;

The flange 61 and in particular the leg 61*a* portion of the bulkhead bracket 60 permits a more uniform sealing load to be applied to the side of the bulkhead 2 whereby to improve the contact of the gasket seal 15 against the surface of the bulkhead; and, The bulkhead bracket 60 permits both the robotic assembly of this element and of the female connector 11 thereto in a vehicle assembly operation.

Figure 4:
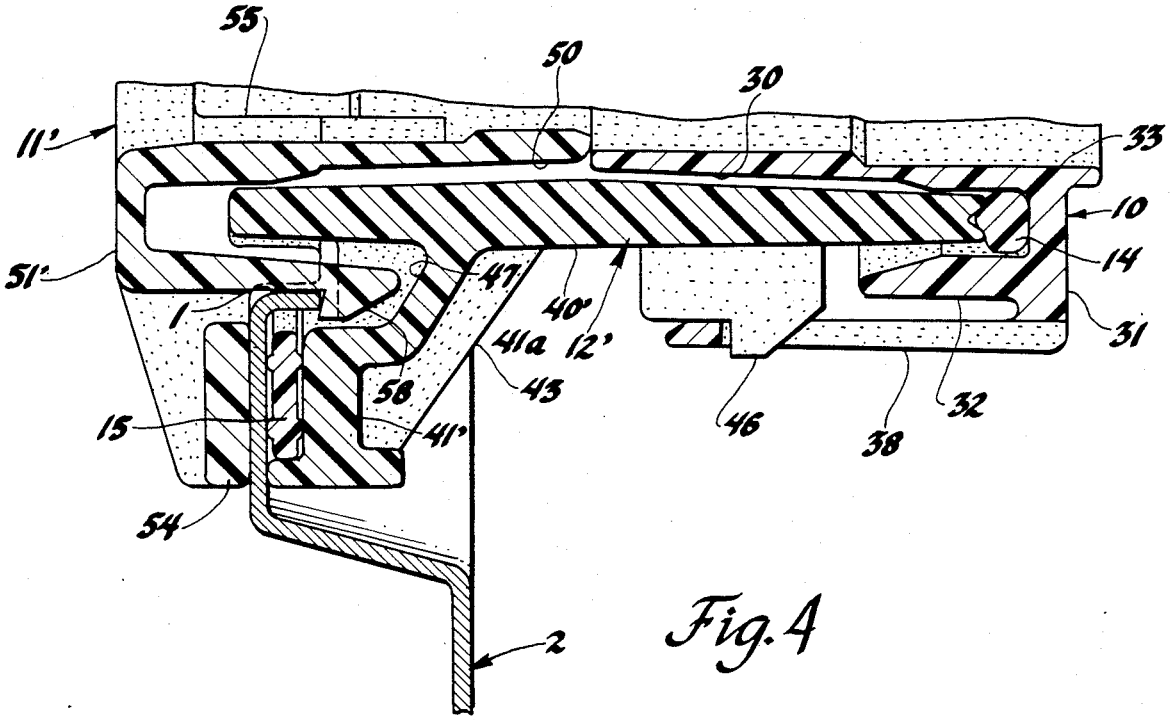
FIG. 4 is a sectional view of a portion of the assembled electrical elements of FIG. 1 but showing an alternate construction of the female connector and shroud of the assembly used to effect bulkhead sealing; and, FIG. 5 is a sectional view of a portion of the assembled elements of FIG. 1 but with another alternate construction of the female connector and shroud, per se, to effect the sealed connection of the shroud to a bulkhead.

An alternate embodiment of a sealed electrical connector with sliding shroud in accordance with the invention is shown in FIG. 4, wherein similar parts are designated by similar numerals but with the addition of a prime (′) where appropriate.

In this alternate embodiment, the radial flange 41′ of the shroud 12′ includes an inclined flange connector portion 41*a′* that is inclined in a direction extending toward the end of the shell 40′ of the shroud receiving the female connector 11′ whereby to define an annular recess 47 next adjacent to and encircling the aperture 1 in the bulkhead 2.

The female connector 11′, in this alternate embodiment, has a flange 51′ portion that terminates at its outer peripheral end in an outer rim 54 sized so as to encircle the aperture 1 and abut against the material of the bulkhead 2 surrounding this aperture 1, so that during torque down of the bolt 20, as previously described, sealing pressure can be applied to the gasket seal 15. In addition, the flange 51′ portion is also provided with a plurality of spaced apart, flexible lock fingers 58 that extend longitudinally toward the inboard end of the female connector 11′ and which are located to hook over the flanged end of the bulkhead 2 material surrounding the aperture 1 therein, only one such lock finger 58 being shown in FIG. 4. With this arrangement the female connector 11′ can be assembled to the bulkhead 2 from the passenger side thereof in position so as to be mated with the shroud 12′ and male connector 10 as installed from the engine compartment side of the bulkhead 2.

Figure 5:
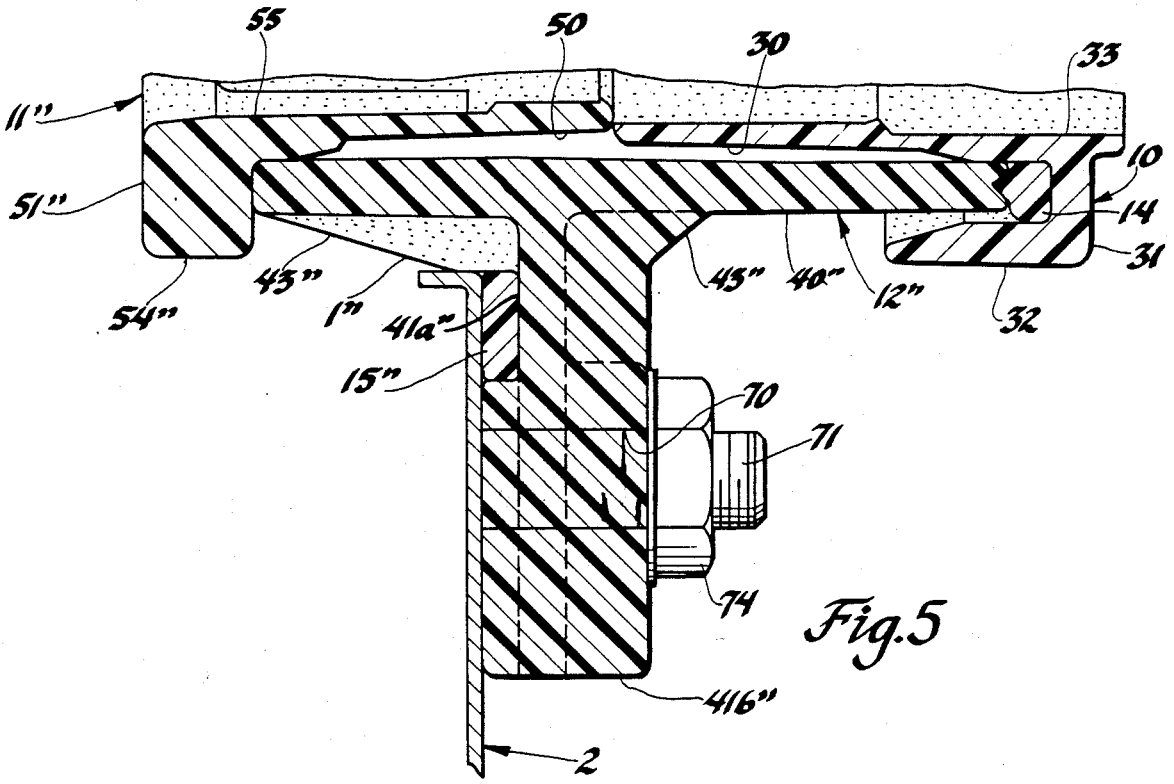

Another alternate embodiment of a sealed electrical connector with sliding shroud in accordance with the invention is shown in FIG. 5, wherein similar parts are designated by similar numerals but with the addition of a double prime (″) where appropriate. In this embodiment, the shroud 12″ has the radial flange 41″ located a substantial distance from the female connector 11″ end of its shell 40″, the left hand end with reference to FIG. 5, with one side surface 41*a″* thereof defining a seating surface for the gasket seal 15″ and, radially outward of this surface 41*a″* the flange 41″ is provided with a plurality of mounting ears 41*b″*, only one such mounting ear 41*b″* being shown in this Figure, with each such mounting ear 41*b″* having an aperture 70 therethrough for receiving an associate weld stud 71 fixed to the bulkhead 2 so as to extend through the aperture 70 so as to receive a nut 74.

As shown in this FIG. 5 embodiment, the material of the bulkhead 2″ defining the aperture 1″ therein, is bent toward the passenger compartment side of the bulkhead 2. With this arrangement, both sides of the radial flange can be provided with circumferentially spaced apart reinforcing ribs 43″ and 43*a″* having on both sides thereof, the latter ribs 43*a″* having a predetermined radial extent so that they will be slidably received through the aperture 1″

Since in this FIG. 5 embodiment, the shroud 12″ is configured for direct sealed mounting onto the bulkhead 2″, the female connector 11 ″ is merely provided with an annular flange 51″ having its outer rim 54″ portion adapted to abut against the associate free end of the shell 40″ of the shroud 12″ in the manner shown.

It should now be apparent that with the electrical connector with sliding shroud assembly of the invention, the so-called bare connectors 16, 17 are completely protected from the environment in the engine compartment, including water splash, since each cavity 33 in the male connector 10 is sealed by a cable seal ring 35; the shroud 12, 12′ or 12″ is sealed relative to the male connector by the seal ring 14; the bolt aperture 22 is sealed by the seal ring 21; and, of course the mating interconnection of each of these terminals 16, 17 is located within the enclosing confines of the shell 40, 40′, 40″ of the shroud 12, 12′ and 12″, respectively.

While the invention has been described with reference to the structures disclosed herein, it is not confined to the details set forth, and this application is intended to cover such modifications or changes as may come within the purposes of the improvements or the scope of the following claims.

The embodiments of the invention in which an exclusive property or privilege is claimed are defined as follows:

1. An electrical connector with sliding shroud assembly adapted for mounting onto an apertured bulkhead including a shroud having a hollow, tubular shell means with orientation guide means on the inner peripheral surface thereof and an outer annular flange extending radially outward from its outer peripheral surface intermediate the ends thereof, said tubular shell having one end thereof adapted to be inserted through an aperture in the bulkhead; a gasket means fixed to said flange on the side thereof adjacent to said one end of said tubular body; a female connector body means having a portion thereof with guide means thereon whereby said portion is slidably received in said one end of said tubular shell as orientated by said guide means thereon; a male connector body means having a portion with guide means thereon whereby said portion is slidably received in the opposite end of said tubular shell as orientated by said guide means thereon; each of said connector portions having a central, longitudinal, fastener receiving aperture and spaced apart, longitudinal, vertically aligned sets of terminal apertures extending therethrough, and a plurality of spaced apart transverse apertures extending through said sets of terminal apertures; electrical terminal means operatively positioned in each of said terminal apertures, each of said terminal apertures in said male connector being sized so as to receive an associate electrical terminal with an electrical cable extending therefrom outboard of said male connector, a cable seal ring sealing encircling each said electrical cable next adjacent to said electrical terminal and the wall means defining an associate said terminal aperture; lock comb means operatively positioned through said transverse apertures to effect axial retention of said electrical terminal means; said male connector body means including an annular return bent flange upstanding from the outboard end of its associate said connector portion to receive the associate end of said tubular body of said shroud; a ring seal located in said return bent flange in position to effect sealing engagement between said shroud and said male connector body means; said female connector body means including an annular flange upstanding from the outboard end of its associate connector portion which is adapted to be operatively associated with a bulkhead to sealingly sandwich said gasket means between said annular flange of said shroud and the bulkhead when the sealed shroud and electrical connector body means assembly is installed on the bulkhead; and, a fastener means including a bolt and a captive nut operatively positioned in said fastener receiving apertures in said male and female connector body means for the axial retention of said female body means relative to said male connector body means and operative to bring said gasket means into sealing engagement with said bulkhead.

2. A sealed shroud and electrical connector body means assembly for mounting to an apertured bulkhead, said sealed shroud and electrical connector body means assembly including a shroud having a hollow, tubular body means with orientation guide means on the inner peripheral surface thereof and an annular flange extending radially outward from its outer peripheral surface intermediate the ends thereof, said tubular body having one end thereof adapted to be inserted through an aperture in the bulkhead; a gasket means fixed to said flange on the side thereof adjacent to said one end of said tubular body; a female connector body means having a connector portion with an inboard end thereof having guide means thereon whereby said inboard end of said connector portion is slidably received in said one end of said tubular body as orientated by said guide means thereon engaging said orientation guide means; a male connector body means having a connector portion with an inboard end thereof having guide means thereon whereby said inboard end of said connector portion is slidably received in the opposite end of said tubular body as orientated by said guide means thereon engaging said orientation guide means; each of said connector portions having spaced apart, longitudinal, vertically aligned sets of terminal apertures extending therethrough, a central, longitudinal, fastener receiving aperture, and a plurality of spaced apart transverse apertures extending through said sets of terminal apertures; electrical terminal means operatively positioned in each of said terminal apertures, each of said terminal apertures in said male connector being sized so as to receive an associate electrical terminal with an electrical cable extending therefrom outboard of said male connector, a cable seal ring sealing encircling each said electrical cable next adjacent to said electrical terminal and the wall means defining an associate said terminal aperture; lock comb means operatively positioned through said transverse apertures to effect axial retention of said electrical terminal means; said male connector body means including an annular return bent flange upstanding from the outboard end of its associate said connector portion to receive the associate end of said tubular body of said shroud; a ring seal located in said return bent flange in position to effect sealing engagement between said shroud and said male connector body means; said female connector body means including an annular flange upstanding from the outboard end of its associate connector portion which is adapted to be operatively associated with a bulkhead to sealingly sandwich said gasket means between said annular flange of said shroud and the bulkhead when the sealed shroud and electrical connector body means assembly is installed on the bulkhead; and, a fastener means including a bolt and a captive nut operatively positioned in said fastener receiving apertures in the said connector portions of said male and female connector body means for the axial retention of said female body means relative to said male connector body means and operative to bring said gasket means into sealing engagement with said bulkhead.

* * * * *